US007811178B2

(12) United States Patent
Davis

(10) Patent No.: US 7,811,178 B2
(45) Date of Patent: Oct. 12, 2010

(54) GOLF HEAD HAVING A PORTED CONSTRUCTION

(75) Inventor: Stephen J. Davis, Newtown, PA (US)

(73) Assignee: Prince Sports, Inc., Bordentown, NJ (US)

( * ) Notice: Subject to any disclaimer, the term of this patent is extended or adjusted under 35 U.S.C. 154(b) by 566 days.

(21) Appl. No.: 11/454,414

(22) Filed: Jun. 16, 2006

(65) Prior Publication Data

US 2007/0293344 A1 Dec. 20, 2007

(51) Int. Cl.
*A63B 69/36* (2006.01)
*A63B 53/04* (2006.01)

(52) U.S. Cl. ..... 473/334; 473/335; 473/340; 473/345; 473/349; 473/249; 473/251; 473/336

(58) Field of Classification Search ..... 473/324–350, 473/219–256, 288–292
See application file for complete search history.

(56) References Cited

U.S. PATENT DOCUMENTS 1,960,110 A * 5/1934 Iles ..... 473/286
2,056,335 A * 10/1936 Wettlaufer ..... 473/245
3,708,172 A * 1/1973 Rango ..... 473/249
4,032,156 A * 6/1977 Clarke ..... 473/253
D257,869 S * 1/1981 MacDougall ..... D21/739
D285,231 S * 8/1986 Solomon ..... D21/733
4,944,515 A * 7/1990 Shearer ..... 473/337
5,244,210 A 9/1993 Au
5,385,348 A 1/1995 Wargo
5,447,309 A * 9/1995 Vincent ..... 473/345
5,518,243 A 5/1996 Redman
5,533,730 A 7/1996 Ruvang
5,570,886 A * 11/1996 Rigal et al. ..... 473/345
6,059,669 A * 5/2000 Pearce ..... 473/339
6,089,994 A 7/2000 Sun
6,123,627 A * 9/2000 Antonious ..... 473/327
6,248,025 B1 6/2001 Murphy et al.
6,254,494 B1 7/2001 Hasebe et al.
6,270,422 B1 8/2001 Fisher
6,306,048 B1 10/2001 McCabe et al.
6,364,788 B1 4/2002 Helmstetter et al.
6,386,990 B1 * 5/2002 Reyes et al. ..... 473/344
6,406,378 B1 6/2002 Murphy et al.
6,406,381 B2 6/2002 Murphy et al.
6,409,612 B1 6/2002 Evans et al.
6,440,008 B2 8/2002 Murphy et al.
6,471,604 B2 10/2002 Hocknell et al.
6,491,592 B2 12/2002 Cackett et al.
6,530,848 B2 3/2003 Gillig
6,565,452 B2 5/2003 Helmstetter et al.
6,575,845 B2 6/2003 Galloway et al.
6,582,323 B2 6/2003 Soracco et al.
6,592,466 B2 7/2003 Helmstetter et al.

(Continued)

*Primary Examiner*—Sebastiano Passaniti
(74) *Attorney, Agent, or Firm*—Abelman, Frayne & Schwab

(57) ABSTRACT

A golf club head has a face, a hosel, and a hollow body. The body includes an outer peripheral region, when viewed from above, and center portions on the upper surface and sole, respectively. The outer peripheral region has a weight-per-unit of surface area which is greater than the weight-per-unit of surface area of the center portions. The weight differential may be accomplished by molding ports into the hollow body around the periphery, which contain weight plugs. Alternately or in addition, a vertically oriented port may extend through the center portions to reduce weight.

15 Claims, 7 Drawing Sheets

U.S. PATENT DOCUMENTS 6,607,423 B1 8/2003 Arcayan et al.
6,607,623 B2 8/2003 Murphy et al.
6,612,938 B2 9/2003 Murphy et al.
6,634,955 B2 * 10/2003 Middleton ..... 473/231
6,648,772 B2 * 11/2003 Vincent et al. ..... 473/334
6,663,504 B2 12/2003 Hocknell et al.
D486,542 S * 2/2004 Burrows ..... D21/752
6,739,982 B2 5/2004 Murphy et al.
6,758,763 B2 7/2004 Murphy et al.
6,881,159 B2 4/2005 Galloway et al.
6,984,181 B2 1/2006 Hettinger et al.
6,994,637 B2 2/2006 Murphy et al.
7,004,852 B2 2/2006 Billings
7,147,573 B2 * 12/2006 DiMarco ..... 473/324
7,166,041 B2 * 1/2007 Evans ..... 473/334
7,314,418 B2 * 1/2008 Galloway et al. ..... 473/345
7,351,161 B2 * 4/2008 Beach ..... 473/334
7,416,496 B2 * 8/2008 Galloway et al. ..... 473/342
7,445,563 B1 * 11/2008 Werner ..... 473/332
7,563,178 B2 * 7/2009 Rae et al. ..... 473/345
2002/0022532 A1 2/2002 Tucker, Sr.
2002/0032075 A1 3/2002 Vatsvog
2002/0137576 A1 9/2002 Dammen
2004/0132541 A1 7/2004 MacIlraith
2004/0138003 A1 7/2004 Grace
2005/0107185 A1 5/2005 Lu
2006/0035717 A1 2/2006 Cover et al.
2006/0094528 A1 5/2006 Murphy et al.
2006/0105856 A1 5/2006 Lo

* cited by examiner

GOLF HEAD HAVING A PORTED CONSTRUCTION

BACKGROUND OF THE INVENTION

The present invention relates to a golf head made of multiple materials to achieve variable weight distribution, whereby the central area of the golf head has minimal mass, and the periphery has maximum mass distribution to maximize the rotational inertia of the golf head. In addition, the periphery is comprised of molded ports to facilitate weight adjustment means.

The performance of a golf head is determined by the physical characteristics of the head such as weight, weight distribution, and rotational moment of inertia. There are other geometric factors which play a role such as face size, face angle, offset, lie angle, etc., but these are not the purpose of the present invention.

The present invention can be applied to a "wood" type head such as a driver or fairway wood, and also a putter. The objective is to take advantage of light weight materials such as fiber reinforced composites, which can provide a reduced weight in the central region of the golf head, and allow molded in higher weight at the periphery, using ports to easily accommodate different weight distributions.

The modern golf club head has used composite materials to achieve different weight distributions. Composite materials, being lighter in weight than metal, can produce a lighter weight golf head with allows for greater weight to be focused in specific locations to achieve desired performance properties.

The below listed U.S. patents and patent applications to the Callaway Golf Company all discuss the use of different materials such as composites to achieve different performance characteristics:

Pub. No. US2006/0094528; U.S. Pat. Nos. 6,994,637; 6,984,181; 6,881,159; 6,758,763; 6,739,982; 6,663,504; 6,612,938; 6,607,623; 6,607,423; 6,592,466; 6,582,323; 6,575,845; 6,565,452; 6,491,592; 6,471,604; 6,440,008; 6,406,381; 6,406,378; 6,386,990; and U.S. Pat. No. 6,248,025.

In addition to concentrating weight at specific locations, it is also desirable to be able to easily adjust the location of weight to accommodate different player preferences. There are numerous patents on weight adjustment means.

U.S. Pat. No. 6,565,452 to Helmstetter, et. al., describes a multiple material golf head with an internal weighting strip to change the center of gravity of the golf head. However, this design does not allow for quick and easy weight adjustment.

U.S. Pat. No. 6,409,612 to Evans, et. al., discloses a golf head with a weighting device comprised of a polymer material, which has a plurality of cavities for placement of high density pellets within some or all of the cavities. This weighting device is removable from the golf head and not integrally molded in, meaning that weight is required for the weighting device which reduces the amount of weight available for adjustment.

U.S. Patent Application No. US2002/0137576 to Dammen discloses a golf club head with weight adjustment means using moveable screws of high specific gravity which are screwed into threaded sleeves inside the golf head. The amount of weight adjustment is limited because the club head is made of metal, which is heavy, as well as the threaded sleeves. It is also limited by the requirement of using threaded means to attach the adjustment weights.

U.S. Pat. No. 6,089,994 to Sun discloses a golf head with a receptacle in its sole with a plurality of apertures for receiving weights. The weight of the removable receptacle limits the amount of adjustment weight. In addition, this design is limited to the sole of the club head.

U.S. Patent Application US2006/0105856 to Lo describes a golf club head with recessed portions, into which are inserted weight members comprised of a lid portion, protrusions, and engaging means. The lid portions can change orientation in the recessed portion, which allows for rapid adjustment of the weight distribution of the club head. This is limited by the weight distribution within each lid portion, and the amount of adjustment weight is limited due to the weight of the lid and engaging means.

U.S. Pat. No. 7,004,852 to Billings describes a golf club head having a hollow cavity with a weighting port. The weighting port allows a user to place weighting material inside the golf head to adjust the center of gravity of the golf head. It is assumed the weighting material is bonded to the interior wall of the golf head, but exactly how to do this is not detailed. It is difficult to precisely locate the weighting material. It is also possible the weighting material may come loose over time and create a rattle noise.

U.S. Patents and patent applications which describe other weight adjustment means are listed below:

Pub. No. US2002/0022532; Pub. No. US2002/0032075; Pub. No. US2004/0132541; Pub. No. US2004/0138003; Pub. No. US2005/0107185

US2006/0035717; U.S. Pat. Nos. 5,244,210; 5,385,348; 5,518,243; 5,533,730; 6,254,494; 6,270,422; 6,306,048; 6,364,788; and 6,530,848.

There exists a continuing need for an improved golf head that has the combined features of low central weight portion, a high perimeter weight portion, and adjustment means to change the weight distribution along the perimeter.

SUMMARY OF THE INVENTION

The present invention is a "wood" type golf club head, such as a driver, or a putter. The golf club head comprises a face, a hollow body having an outer surface, and a hosel. The hollow body has an upper surface and a sole. Viewed from above, the hollow body has an outer periphery and a peripheral region containing said outer periphery. The upper surface has a first center portion, located inwardly of the peripheral region, and the sole has a second center portion, located inwardly of the peripheral region. Finally, the outer peripheral region has an average weight-per-square centimeter of outer surface area which is substantially greater than the average weight-per-square centimeter of outer surface area of the center portions.

The face of the club head and the hosel are preferably formed of a heavier material such as steel or titanium.

The peripheral region of the club head body can be comprised of a metal material to increase the perimeter weighting, or weight inserts located inside a light weight material body to achieve a similar effect. Preferably, the light weight body has ports formed along the periphery to accommodate heavy inserts which can be easily inserted and removed to quickly adjust the weight distribution of the club head.

The light weight body is preferably made from fiber reinforced composite. The ports are formed in the composite shell by a molding process that forms at least one, and preferably a series, of "ports" that extend into the hollow club head. The ports provide a means to insert different weight plugs to change the weight distribution of the club head.

An alternative design is to have the peripheral wall of the port extend through the club head, between holes in opposing sides, to form a through passage. Each port is defined by a peripheral wall, the opposite ends of which are bonded to the walls of the club head. The wall forming the port, which extends between opposite sides of the club head, preferably is shaped to act as opposing arches which provide additional strength, stiffness, comfort, and aesthetic benefits.

The center portions of the club head are comprised of a light weight material such as carbon fiber reinforced epoxy resin to minimize the weight in this area. An alternative design is to create a zero weight area in the central portion by forming a large port in this area.

The present invention applies preferably to wood type golf club heads and putter heads, or any golf club head which has a hollow body to it to take advantage of the improved stability resulting from improved perimeter weighting.

The present invention provides a high ratio of weight in the peripheral region to weight in the center regions.

The present invention provides easy adjustment means for distributing weight around the perimeter of the club head.

The present invention is provides a high ratio of weight adjustment means in proportion to total club head weight.

The present invention provides an option of tubular internal reinforcements by connecting ports on opposite sides of the club head.

The present invention provides a new and improved golf club head which may be easily and efficiently manufactured.

The present invention provides a new and improved golf club head which is of durable and reliable construction.

The present invention provides a new and improved golf club head which may be manufactured at low cost with regard to both materials and labor The present invention provides an improved golf club head that has an improved sweet spot size resulting in reduced shot dispersion for off center hits, and greater shock absorption.

The present invention provides an improved golf club head where the stiffness of the body can be affected by the orientation of the through ports.

The present invention provides an improved golf shaft that has a unique look and improved aesthetics.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

For a better understanding of the invention and its advantages, reference should be made to the accompanying drawings and descriptive matter in which there are illustrated preferred embodiments of the invention.

BRIEF DESCRIPTION OF THE DRAWINGS

The same reference numerals refer to the same parts throughout the various Figures.

DETAILED DESCRIPTION OF THE INVENTION

Figure 1:
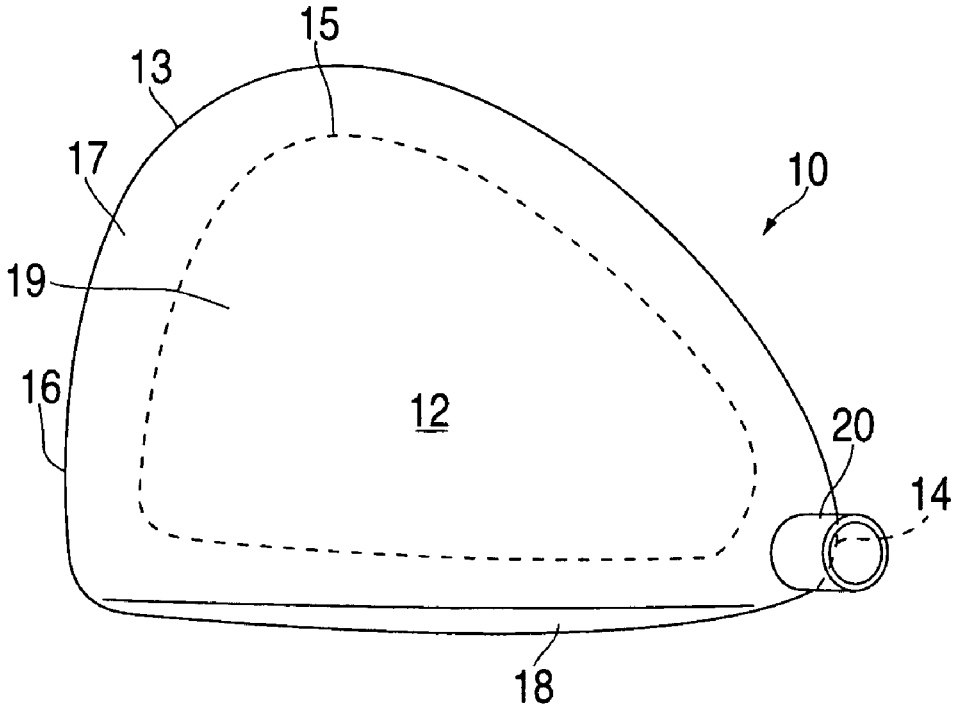
FIG. 1 is a plan view of a golf club head constructed in accordance with an embodiment of the present invention.

FIG. 1 shows an example of a driver club head having a hollow body, or shell 10, defining a top surface 12, a heel 14, and a toe 16. The club head further includes a front face 18 and a hosel 20 extending from the top surface 12. The shell 10 defines a hollow interior, and can be comprised of several materials depending on the weight distribution desired. The face 18 may also be selected from various materials and may either be integral with the shell 10 (as in FIG. 1) or a separate piece (as in FIG. 2, described below).

The shell 10, viewed from above, has an outer periphery 13 which extends from the heel, around the rear of the shell 10, to the toe generally in a horizontal plane. A peripheral region 17, whose approximate boundary is defined by broken line 15, also extends above and below the periphery from the heel, around the rear of the shell 10, to the toe. Thus, a center portion 19 lies inside the boundary 15. A similar center portion is preferably present in the sole. However, if it is desired to lower the center of gravity, additional weight may be added to the center portion of the sole.

The peripheral region 17 can be molded as a one piece unit with the remainder of the shell 10 and optionally also the front face 18 and the hosel 20. The peripheral region 17 is preferably fabricated of a heavier material than the remainder of the shell 10 to increase the polar moment of inertia of the club head, so to resist off center hits. Thus, the center portion 19 of the club head and, if desired, the corresponding center portion on the sole, is fabricated of a light weight material such as carbon fiber reinforced composite to minimize weight in this area.

Figure 2:
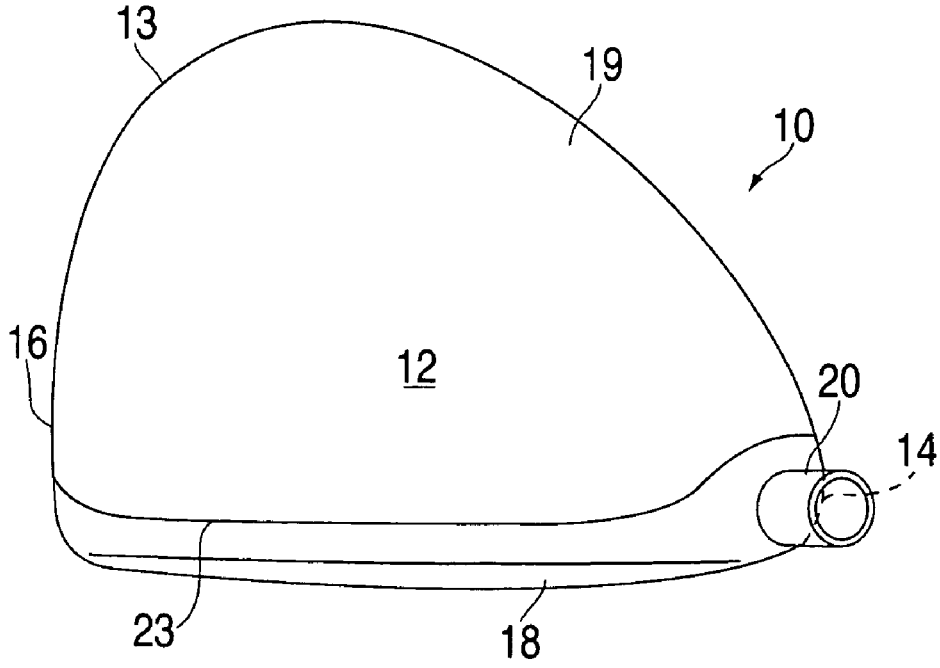
FIG. 2 is a plan view of a golf club head constructed in accordance with an alternative embodiment of the present invention.

FIG. 2 shows an alternative design where the front face 18 and hosel 20 are fabricated as a single piece of metal material such as steel or titanium with the shell 10 molded of a light weight material such as carbon fiber epoxy. The line 23 shows the approximate border between the heavy weight portion of the front face 18 and hosel 20 and the shell 10. The shell 10 is lighter in weight than the design shown in FIG. 1, and therefore provides an opportunity to add weight adjustment means along the periphery 13. After weights are added to the peripheral region, it will have a higher weight ratio than the center portion 19.

Figure 3:
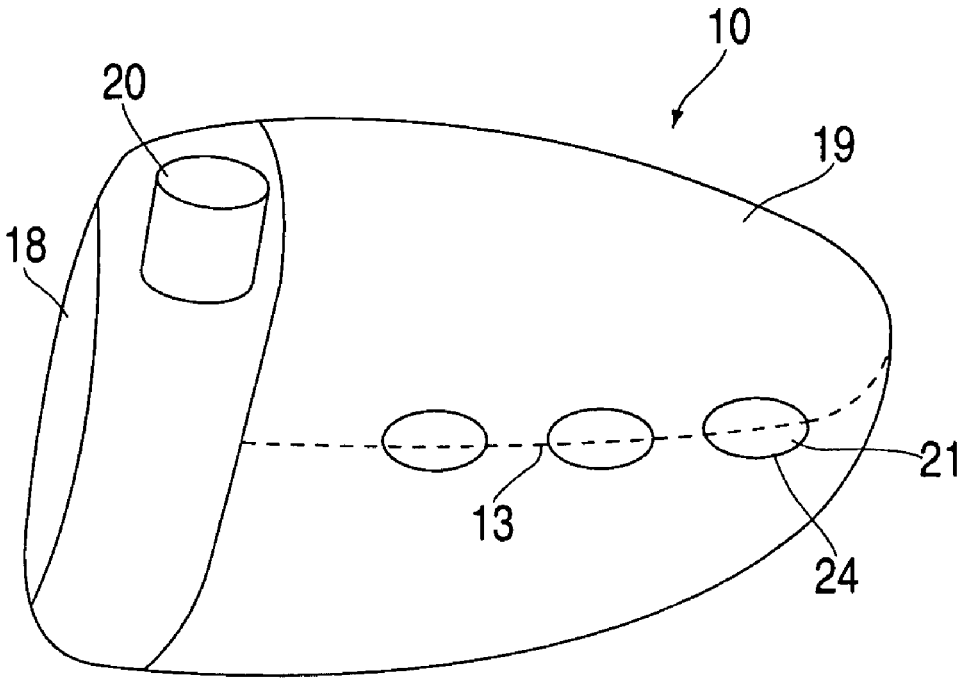
FIG. 3 is a rear view of a golf club head constructed in accordance with another embodiment of the present invention.

The shell 10 can be molded with "ports" around its perimeter 13 for receiving weight plugs 21. FIG. 3 shows a rear view of the club head showing the front face 18 and hosel 20 as a one piece unit. In a process described further below, the shell 10 is preferably fabricated of multiple layers of aligned carbon filaments held together with an epoxy binder, i.e., so-called "graphite" material. The fibers in the various plies are parallel to one another, but the various plies preferably have varying fiber orientations.

A plurality of "ports" 24 are formed in the wall of the shell 10, preferably along the outer periphery 13, which connects between the toe region 16 and heel region 14. The ports 24 extend into the hollow cavity of the shell 10, or are molded as a ported ribbon, both options of which are described further below. Each port is preferably round or oval in cross-sectional shape, with the axis of the ports in line with the horizontal. Each port 24 can receive a weight plug 21, whose external shape corresponds to the interior shape of the port 24. The plugs 21 can be secured inside the ports 24 in any suitable manner.

Figure 4:
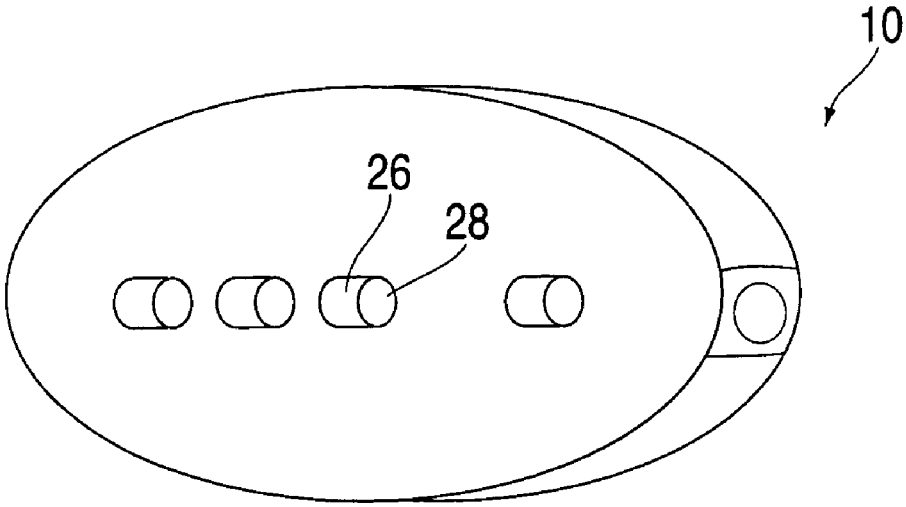
FIG. 4 is an internal isometric view of the golf club head of FIG. 3, with the face removed.

FIG. 4 shows an internal isometric view of club head 10, i.e., a view with the front face removed, showing the ports 24 molded as "blind" ports, or internal tubes with closed ends. This option provides a means to insert weight adjustment plugs into, or removed weight plugs from, each blind port from the outside of the club head. In addition, the blind ports seal off the internal cavity of club head 10 so no debris can enter the club head and create a rattle. Another option is to cover any empty ports with a cover plate.

Each port 24 includes a peripheral wall 26 that extends from the outer shell 10 to the closed end 28 of the port. The ports can be of any size and quantity depending on the amount of weight distribution desired. The ports, being fabricated of a light weight composite material, minimize the weight of the club head to allow for greater weight adjustment means.

FIG. 4 shows the ports 24 all in one horizontal plane, disposed around the periphery of the club head shell 10. These are the most efficient locations to concentrate weights to maximize the polar moment of inertia about vertical axis through the club head. It is also possible to locate the ports anywhere on the club head to stabilize the club head in various directions.

Figure 5:
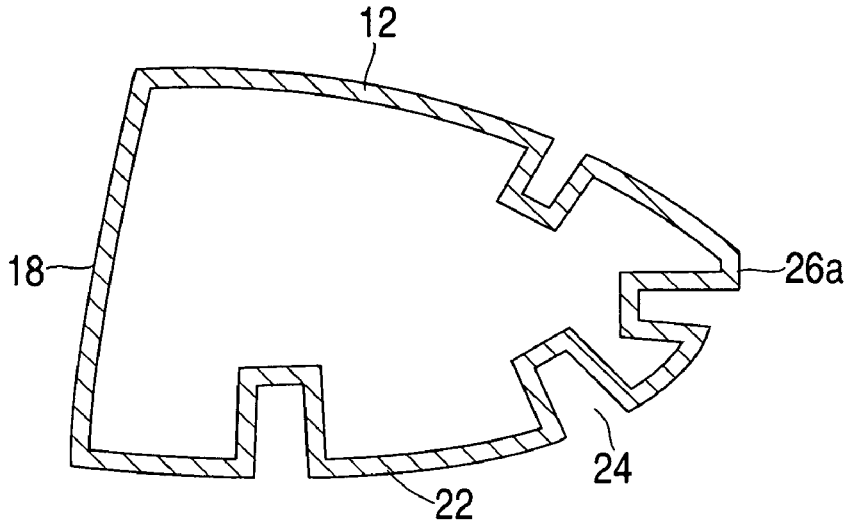
FIG. 5 is a vertical sectional view of a golf club head constructed in accordance with another embodiment of the present invention.

FIG. 5 shows a vertical section of another embodiment of a club head with the ports 24 at various locations and orientations. It is possible to locate the ports on the sole portion 22, the top surface 12, as well as the ribbon portion 26*a*, which is the portion between the top surface 12 and sole portion 22. It is also possible to orient the axis of the ports at any practical angle desired.

Figure 6:
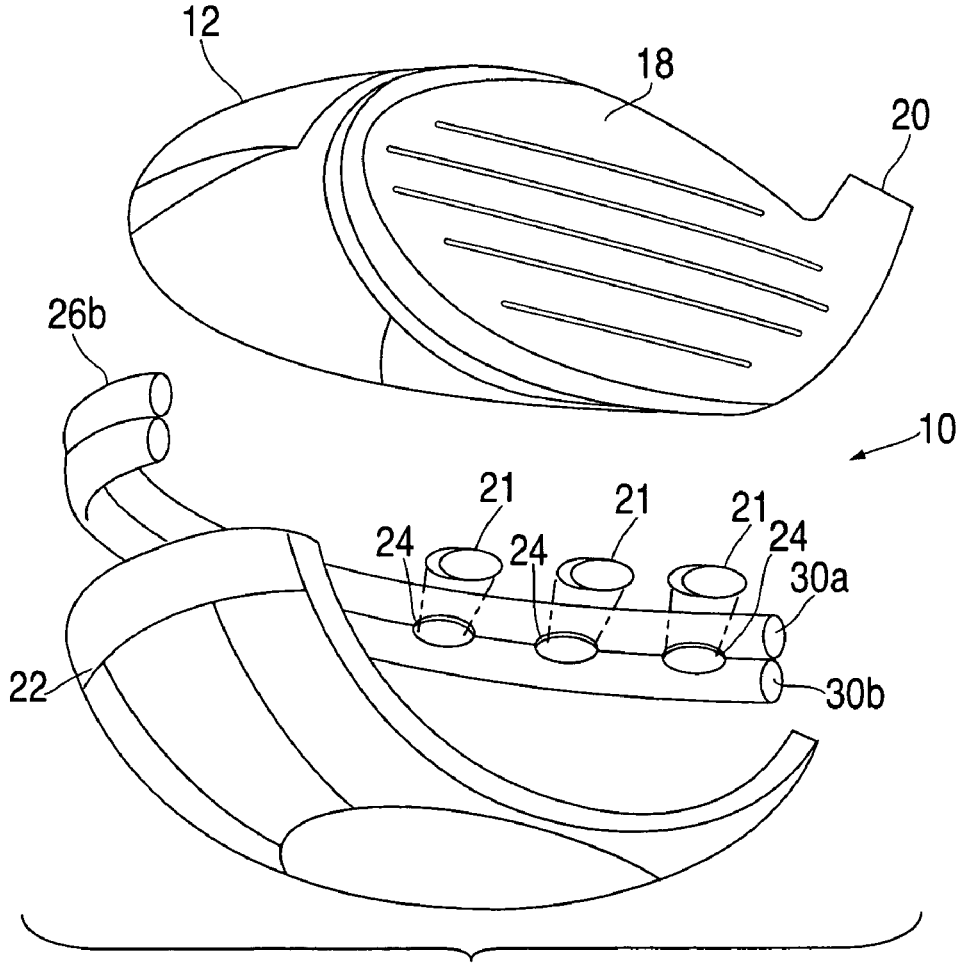
FIG. 6 is an isometric exploded view of an alternative embodiment of the golf club head.

An alternative way of molding ports into the club head is shown in FIG. 6. In this example the front face 18 and hosel 20 are molded as a unitary part. The shell 10 is formed of three pieces, a top surface 12, a sole portion 22, and a ribbon portion 26*b*. The top surface 12 and sole portion 22 can be fabricated of a light weight material such as carbon fiber/epoxy composite. The ribbon portion 26*b* can also be fabricated using a light weight composite. In this example, 2 prepreg tubes 30*a* and 30*b* are used to form the ribbon 26*b* which are separated at various locations to form the ports 24. The prepreg molding process will be described later. The ports 24 can be open style, meaning that the interior cavity of the club head is exposed, or have closed ends as previously described, to seal the interior cavity of club head. Also, weight plugs 21 (one of which is shown in FIG. 6) are provided which may be inserted into the ports 24.

The design described in FIG. 6 has numerous advantages. The two tube design creates a strong internal wall between the tubes. This is described, e.g., in U.S. Pat. No. 6,071,203. The ports formed between the tubes are preferably oval shaped, with half of each port shaped like an arch, to provide strength from this geometric shape.

Figure 7:
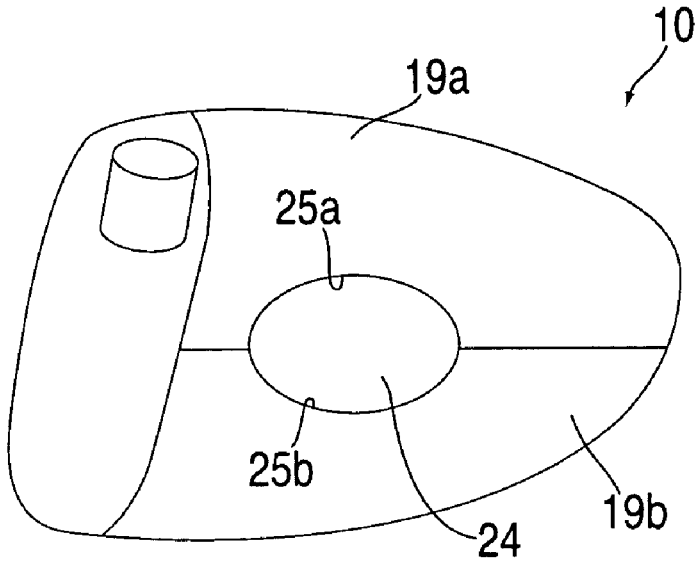
FIG. 7 is a rear view showing an alternative embodiment of the golf club head.

Another option using the 2 tube molding process is to create at least one port which extends through the hollow interior of the club head, between opposite sides. FIG. 7 shows a rear view of the club head 10 with the front face 18 and hosel 20 fabricated as a one piece unit. The shell 10 is divided into an upper portion 19*a* and a lower portion 19*b*, between which is molded a large through port 24. The through port 24 has cylindrical walls 25*a* and 25*b* which contact the shell of the club head at the outer surface of portions 19*a* and 19*b* respectively. The cylindrical walls 25*a*, 25*b* connect to the opposing sides of the club 10, therefore creating a continuous internal port in the club head. In other words, the tubular wall forming the port 24, which tubular wall is formed by the upper and lower wall sections 25*a*, 25*b*, has opposite ends which are bonded, respectively, to the toe 16 and heel 14 so as to extend completely through the club head.

This option provides several advantages. As oriented in FIG. 7, the through port 24 provides an aerodynamic benefit for the club head. This is because during most of the golf swing, the through port 24 is in line with the direction of travel, until the wrists pronate and rotate the club head to present the front face to golf ball. The through port 24 allows air to pass through the club head to facilitate the swing.

The though port 24 can also affect the stiffness of the club head body. The location, orientation, size, and construction of the through port will determine the performance of the club head. This can affect how the ball rebounds off the face of the club head, as well as the sound of the ball impact.

Figure 8:
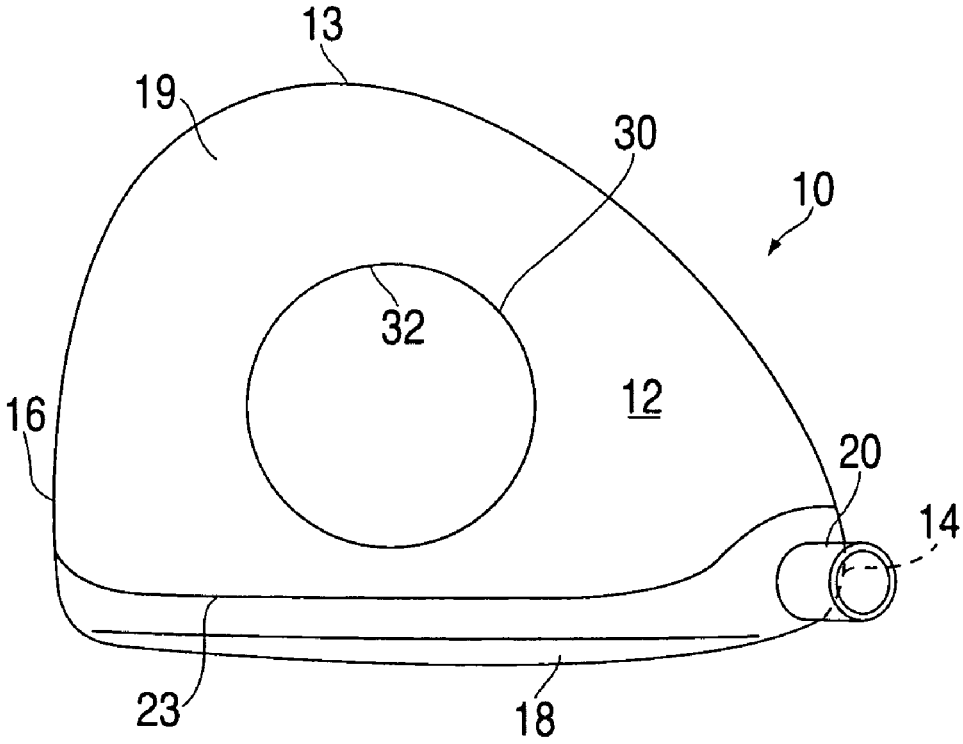
FIG. 8 is a plan view showing an alternative embodiment of the golf club head.

Another design alternative is shown in FIG. 8. In this example, a large through port 30 with its axis oriented vertically is located in the light weight center portion 19 of the shell 10. The cylindrical wall 32 of the port 30 connects extends between the top surface 12 and bottom surface 22(not shown) of the club head. In this example, the front face 18 and hosel 20 are formed as a unitary structure and attached or bonded to the shell 10. Alternately, the front face and hosel may be molded as a unitary structure with the shell 10. The port 30 eliminates all weight in the central portion 19 of the club head, which transfers more weight to the perimeter of the club head for improved stability on off center hits.

Alternatively, the weight savings from port 30 can be redistributed in the form of weight plugs located in ports molded around the perimeter 13 of the club head 10.

Figure 9A:
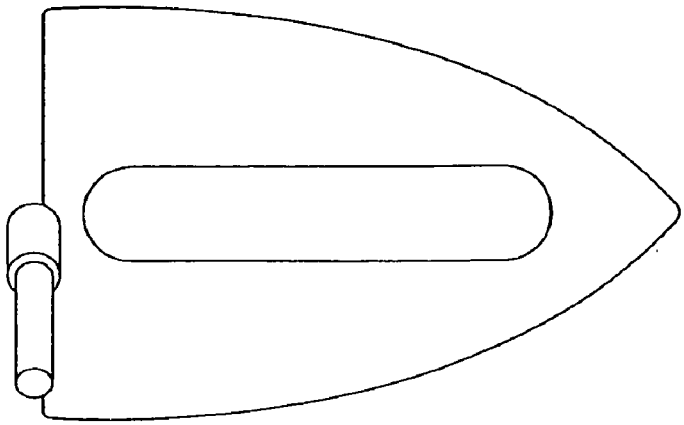
FIGS. 9*a,b,c* shows alternative designs of FIG. 8.
Figure 9B:
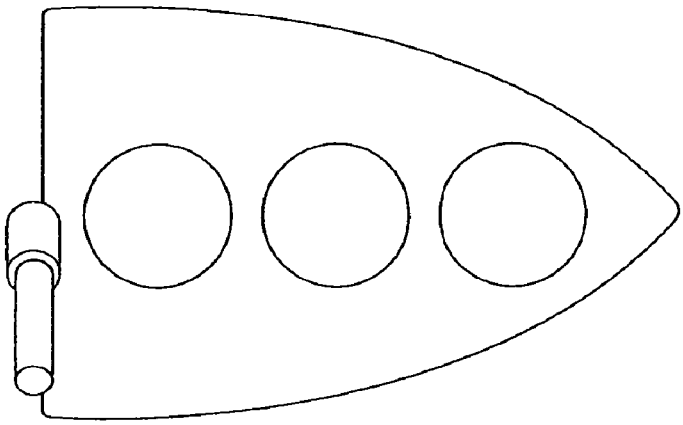
Figure 9C:
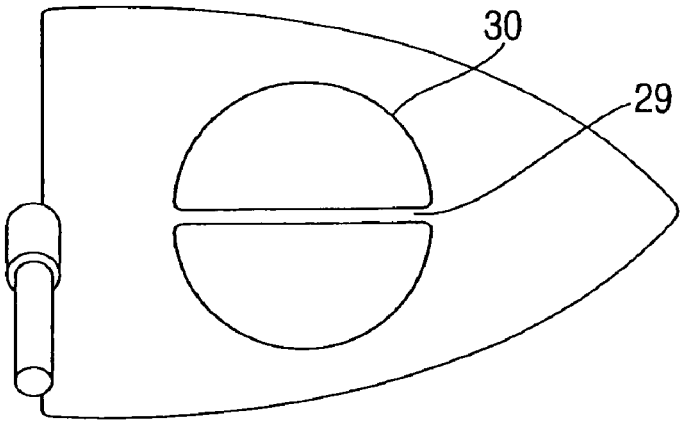

The port 30 can be of any shape and size. For example, the port 30 can be the approximate shape of a golf ball to aid the golfer in position and alignment. FIGS. 9*a,b* show other examples of club head shapes and port geometries. FIG. 9*c* shows a light weight strut 29 molded across the port 30 to aid in alignment.

In addition to traditional materials such as steel and titanium, the fabrication of the golf club head of the present invention is preferably made from a long fiber reinforced composite materials. Traditional lightweight composite structures have been made by preparing an intermediate material known as a prepreg which is used to mold the final structure.

A prepreg is formed by embedding the fibers, such as carbon, glass, and others, in resin. This is typically done using a prepreg machine, which applies the non-cured resin over the fibers so they are all wetted out. The resin is at an "B Stage" meaning that only heat and pressure are required to complete the cross linking and harden and cure the resin. Thermoset resins like epoxy are popular because they are available in liquid form at room temperature, which facilitates the embedding process.

A thermoset is created by a chemical reaction of two components, forming a material in a nonreversible process. Usually, the two components are available in liquid form, and after mixing together, will remain a liquid for a period of time before the cross-linking process begins. It is during this "B Stage" that the prepreg process happens, where the resin coats the fibers. Common thermoset materials are epoxy, polyester, vinyl, phenolic, polyimide, and others.

The prepreg sheets are cut and stacked according to a specific sequence, paying attention to the fiber orientation of each ply.

Each prepreg layer comprises an epoxy resin combined with unidirectional parallel fibers from the class of fibers including but not limited to carbon fibers, glass fibers, aramid fibers, and boron fibers.

The prepreg is cut into strips at various angles and laid up on a table. The strips are then stacked in an alternating fashion such that the fibers of each layer are different to the adjacent layers. For example, one layer may be +45 degrees, the next layer −45 degrees. If more bending stiffness is desired, a fiber angle such as zero degrees is used. If more torsional stiffness is desired, a higher proportion of higher angle strips such as ±45 degree strips are used. Other fiber angles may also be used.

Figure 10:
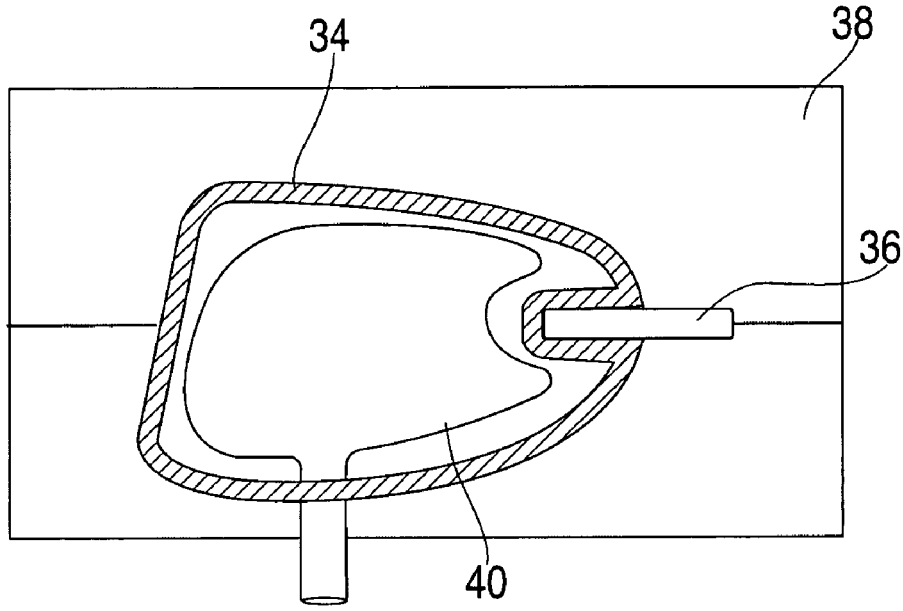
FIG. 10 illustrates a method of manufacture for the golf club head.

This layup, which comprises various strips of prepreg material, is then prepared for molding. Referring to FIG. 3, according to the preferred embodiment of the invention, a suitable prepreg preform is formed in the manner just described, with the various composite plies oriented at the desired angles. FIG. 10 shows the molding process for the club head. The prepreg is formed into a shape 34 which generally follows the body shape of the club head. If a port with a closed end is molded into the part, the prepreg form 34 will wrap around a pin 36. The pin 36 is positioned in the mold 38 and can be retracted after molding to form the closed end port. Internal to the prepreg form 34 is placed a bladder 40. The bladder is internally pressurized to expand and consolidate the prepreg form 34 against the cavity of mold 38. The mold is heated up which allows the epoxy resin to flow and eventually cross link and cure. The internal pressure of the bladder combined with the higher molding temperature will cause the epoxy risen to lower in viscosity, allowing the prepreg form 34 to assume the shape of the mold cavity as well encapsulate around the pin 36. Once the molding operation is complete, the mold 38 is opened, the pin 36 is removed as well as the bladder 40. The bladder 40 will typically enter the club head from the sole region. The hole for the bladder will typically be covered up with plate or other cover.

Figure 11:
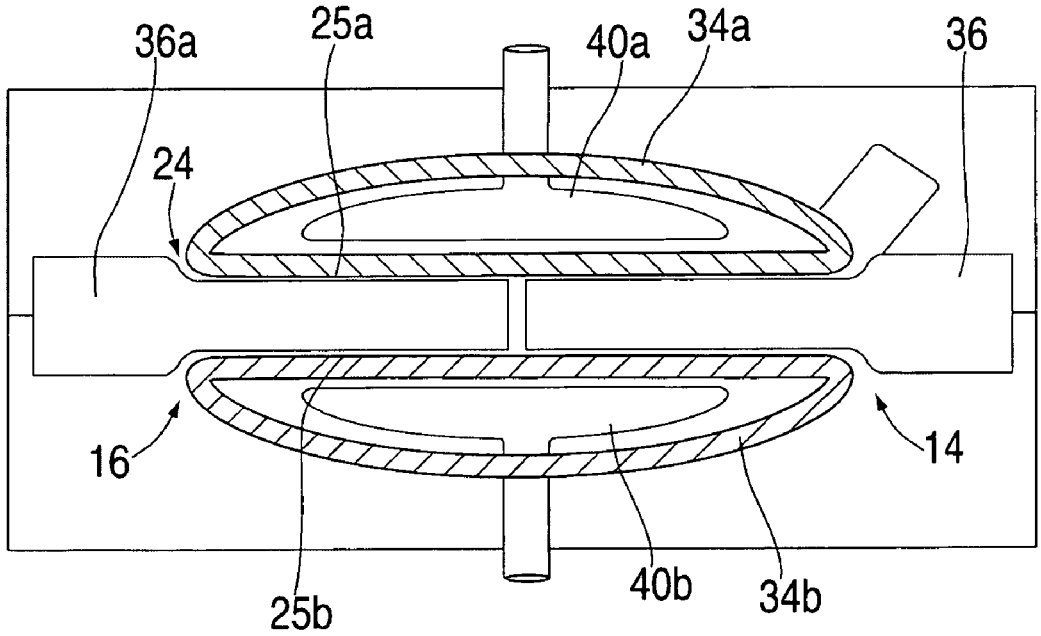
FIG. 11 illustrates an alternative method of manufacture for the golf club head

An manufacturing method to produce a through port design such as shown in FIG. 7 is shown in FIG. 11. In this example, a pair of inflatable bladders 40*a*, 40*b* are inserted through prepreg forms 34*a* and 34*b* respectively such that their facing walls 25*a*, 25*b* are contacting the pins 36*a* and 36*b*. This method can produce the through port 24 with continuous walls 25*a* and 25*b*, which connect between the toe side 16 and heel side 14. The pins 36*a* and 36*b* contact each other and retract in opposite directions to form the through port 24.

The above method can also be used to fabricate the structure shown in FIG. 6. In this example, two prepreg tubes 30*a*, 30*b* are internally inflated to form the ribbon wall 26 around the perimeter of the club head 10. The tubes 30*a* and 30*b* are separated at various locations to form ports 24. The sole plate 22 and top plate 12 can be prepreg material also, and joined with the ribbon 26 by overlapping prepreg reinforcements. The assembly comprised of the top plate 12, the sole plate 22, and the ribbon 26 are molded to the front face 18 and hosel 20 using a third internal bladder to consolidate all parts to produce the golf club head.

Figure 12:
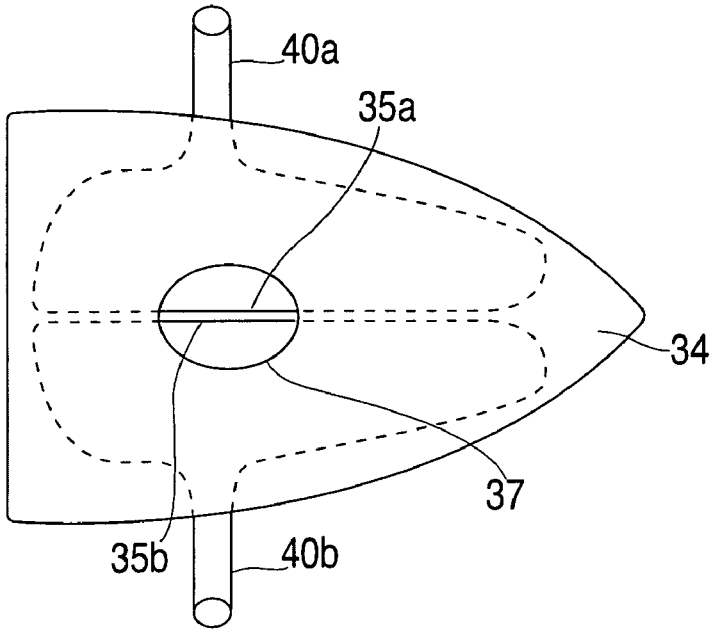
FIG. 12 illustrates another alternative method of manufacture for the gold club head.

Referring again to FIG. 7, it is also possible to form the through port 24 by using one prepreg form and two bladders. FIG. 12 shows a single prepreg form 34. The fibers on opposing sides of the prepreg form 34 are separated to form holes 37. The holes, at this stage, need not have the final desired shape.

Next, a pair of inflatable bladders 40*a*, 40*b*, are inserted in the prepreg form 34 such that their facing walls 35*a*, 35*b* are aligned with the holes 37.

Figure 13:
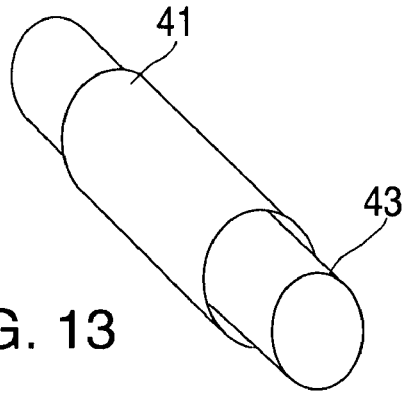
FIG. 13 is an isometric view of the prepreg tube during a part of the manufacturing process of FIG. 12.

Referring to FIG. 13, after the bladders 40*a*, 40*b* have been inserted, a cylindrical prepreg plug 41 is inserted through each of the holes 37, between the facing walls 35*a*, 35*b* of the bladders. Inside the prepreg plug 41 is a metal pin 43 which will form the internal geometry of the molded through port 24.

Figure 14:
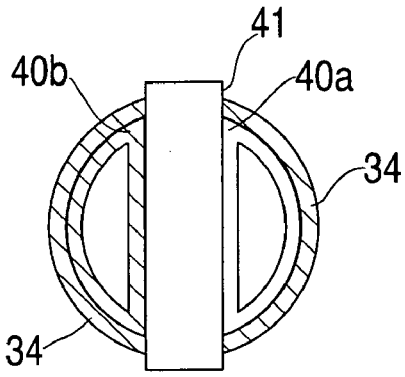
FIG. 14 is a cross sectional view of the prepreg tube inserted in the prepreg form during a part of the manufacturing process of FIG. 12.

The ends of the prepreg plugs 41 preferably extend beyond the outer surfaces of the prepreg form 34, as shown in FIG. 14. The plugs are preferably tubes of prepreg material. However, if desired the plugs may be made of other materials such as metal or plastic.

Air fittings are applied to the ends of each bladder. The mold is then closed over the prepreg form 34 and placed in a heated platen press. For epoxy resins, the temperature is typically around 350 degrees F. While the mold is being heated, the bladders 40*a*, 40*b* are internally pressurized, which compresses the prepreg material and forces the prepreg form 34 to assume the shape of the mold. At the same time, the heat cures the epoxy resin. The bladders also compress the peripheral walls of the plug 41, so that the inwardly facing surface of each plug conforms to the shape of the mold pin 43 (which is preferably oval). At the same time, the heat and pressure cause the ends of the plug walls to bond to the wall of the prepreg form 34.

Once cured, the mold is opened in the reverse sequence of packing. The pins 43 are typically removed first, followed by the mold halves.

The composite material used is preferably carbon fiber reinforced epoxy because the objective is to provide reinforcement at the lightest possible weight. Other fibers may be used such as fiberglass, aramid, boron and others. Other thermoset resins may be used such as polyester and vinyl ester. Thermoplastic resins may also be used such as nylon, ABS, PBT and others.

The size and spacing of the ports can affect weight distribution in a desirable way. A larger or longer port can accept a higher weight plug. Changing the weight distribution more toward the toe, or the heel, or the rear of the club head will affect performance to accommodate a variety of playing styles.

The ports can be designed to allow for rapid weight changes. The ports can be designed to accommodate a quick release mechanism, so that a weight may be added in rapid fashion. For example, a retaining ring could be located within the cylinder of the port to act as a retention device for the weight. Another option is to vary the diameter of the molded ports, so that the diameter near the exterior of the club head is greater than the interior, to lock in the weight plugs.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A golf club head comprising a club face, a body comprised of a shell having a shaped wall, said wall having an outer surface and an inner surface;

wherein said club face and body are configured such that, when attached to a shaft, such assembly forms a putter;

wherein said body has an upper surface and a sole;

wherein said body, viewed from above, has an outer periphery and a peripheral region containing said outer periphery;

wherein said upper surface has a first center portion, located inwardly of said peripheral region; and further comprising a vertically oriented port defined by a peripheral wall which extends between said upper surface in said first center portion and said sole, said port having opposite ends which are open and secured to said upper surface and sole, respectively;

wherein said club face and the inner surface of said body are spaced from said peripheral wall to define an enclosed, hollow interior of said head; and wherein said outer peripheral region has an average weight-per-unit of outer surface area which is substantially greater than the weight-per-unit of outer surface area of said center portion.

2. A golf club head as defined in claim 1, wherein said shell is molded of a light weight, composite material; wherein said peripheral wall of said port is formed of a composite material; and wherein said opposite ends of said port are bonded to said shell.

3. A golf club putter head comprising a club face and a body which supports said club face, wherein said body has a peripheral region comprising at least one pair of hollow tubes made of composite material, an outer periphery extending from opposite ends of said club face, and an attachment section for attaching a shaft;

wherein when said body is attached to a shaft, such assembly forms a putter;

wherein when said club face is orientated to hit a golf ball, said hollow tubes are positioned vertically relative to one another and have facing surfaces which lie generally in a horizontal plane;

wherein said hollow tubes have non-facing surfaces which form at least a portion of said outer periphery; and wherein said facing surfaces are fused together along parts of the lengths of said hollow tubes and are separated from one another along other parts of their lengths so as to form ports having axes which are at least generally horizontal; which ports extend from said outer periphery between the hollow tubes; and which ports include walls formed by portions of said hollow tubes.

4. A golf club head as defined in claim 2, and further comprising at least one additional port which extends through the wall of said body at said peripheral region and into said enclosed, hollow interior of said head.

5. A golf club head according to claim 4, wherein said at least one additional port contains a weight plug secured therein.

6. A golf club head according to claim 5, wherein said body includes a plurality of additional ports extending through the wall of said body at said peripheral region, wherein a plurality of said additional ports each contain a weight plug secured therein.

7. A golf club head according to claim 5, wherein said weight plugs are removably secured in said additional ports.

8. A golf club head according to claim 1, wherein said vertically oriented port is shaped to assist in aligning the club head for a putt.

9. A golf club head according to claim 1, wherein said side-by-side tubes extend from opposite sides of said club face.

10. A golf club head according to claim 1, wherein said peripheral region comprises at least one pair of hollow, side-by-side tubes made of composite material which extend along at least a portion said peripheral region and which are bonded together along at least parts of their lengths.

11. A golf club head according to claim 10, wherein said side-by-side tubes extend from at least one side of said club face along at least a portion of said periphery.

12. A golf club head according to claim 11, wherein said side-by-side tubes extend from opposite sides of said club face.

13. A golf club head according to claim 10, wherein said tubes are separated from one another along other parts of their lengths to form hollow ports.

14. A golf club putter head as defined in claim 3, wherein said body includes an upper portion and a sole, wherein said side-by-side tubes extend along said periphery between at least a portion of said upper portion and said sole.

15. A golf club putter head as defined in claim 3, wherein said side-by-side tubes extend from at least one side of said club face.

* * * * *